US006692635B2

(12) United States Patent
Didillon et al.

(10) Patent No.: US 6,692,635 B2
(45) Date of Patent: Feb. 17, 2004

(54) PROCESS FOR THE PRODUCTION OF GASOLINES WITH LOW SULFUR CONTENTS

(75) Inventors: Blaise Didillon, Rueil-Malmaison (FR); Denis Uzio, Marly le Roi (FR); Nathalie Marchal, Saint Genis Laval (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 09/511,489

(22) Filed: Feb. 23, 2000

(65) Prior Publication Data

US 2003/0168380 A1 Sep. 11, 2003

Related U.S. Application Data

(60) Provisional application No. 60/129,333, filed on Apr. 15, 1999.

(30) Foreign Application Priority Data

Feb. 24, 1999 (FR) ..... 99 02336

(51) Int. Cl.[7] ..... C10G 65/02; C10G 65/04; C10G 65/06

(52) U.S. Cl. ..... 208/211; 208/210; 208/212; 208/213; 208/215; 208/216 R; 208/217; 585/259

(58) Field of Search ..... 208/210, 211, 208/212, 213, 215, 216 R, 217; 585/259

(56) References Cited

U.S. PATENT DOCUMENTS

| | | | | | |
|---|---|---|---|---|---|
| 3,277,199 | A | * | 10/1966 | Poll | 585/258 |
| 5,364,998 | A | * | 11/1994 | Sarrazin et al. | 585/259 |
| 5,409,596 | A | * | 4/1995 | Fletcher et al. | 208/89 |
| 5,906,730 | A | * | 5/1999 | Hatanaka et al. | 208/210 |
| 5,985,136 | A | | 11/1999 | Brignac et al. | 208/216 R |
| 6,007,704 | A | * | 12/1999 | Chapus et al. | 208/218 |
| 6,017,443 | A | * | 1/2000 | Buchanan | 208/210 |
| 6,072,091 | A | * | 6/2000 | Cosyns et al. | 585/259 |
| 6,187,173 | B1 | * | 2/2001 | Chapus et al. | 208/97 |

FOREIGN PATENT DOCUMENTS

| | | |
|---|---|---|
| EP | 0 755 995 | 1/1997 |
| EP | 0 870 817 | 10/1998 |
| WO | 94/22980 | 10/1994 |
| WO | 97/03150 | 1/1997 |

* cited by examiner

*Primary Examiner*—Walter D. Griffin
(74) *Attorney, Agent, or Firm*—Millen, White, Zelano & Branigan, P.C.

(57) ABSTRACT

Process for the production of gasoline with a low sulfur content that comprises at least the following two stages:

a) a hydrogenation stage of the unsaturated sulfur containing compounds, b) a decomposition stage of saturated sulfur containing compounds, and optionally a preliminary stage for pretreatment of the feedstock such as selective hydrogenation of dienes.

19 Claims, No Drawings

PROCESS FOR THE PRODUCTION OF GASOLINES WITH LOW SULFUR CONTENTS

CROSS-REFERENCE TO RELATED APPLICATION

This application claims priority under 35 U.S.C. 119(e) of U.S. Provisional application 60/129,333 filed Apr. 15, 1999.

In addition, this application claims priority of French application serial number 99/02.336 filed Feb. 24, 1999.

This invention relates to a process for the production of gasolines with low sulfur contents that makes it possible to upgrade the entire gasoline fraction that contains sulfur, to reduce the total sulfur contents of said gasoline fraction to very low levels, without appreciable reduction of the gasoline yield and by minimizing the reduction of the octane number caused by the hydrogenation of the olefins.

PRIOR ART

The production of reformulated gasolines that meet new environmental standards requires in particular that their olefin concentration be reduced slightly but that their concentration in aromatic compounds (mainly benzene) and sulfur be reduced to a significant extent. The catalytic cracking gasolines, which may represent 30 to 50% of the gasoline pool, have high olefin and sulfur contents. The sulfur that is present in the reformulated gasolines can be nearly 90%, attributed to the catalytic cracking gasoline (FCC, "Fluid Catalytic Cracking," or fluidized bed catalytic cracking). The desulfurization (hydrodesulfurization) of gasolines and mainly FCC gasolines is therefore of obvious importance for achieving the specifications.

Hydrotreatment (hydrodesulfurization) of the feedstock that is sent to catalytic cracking results in gasolines that typically contain 100 ppm of sulfur. The hydrotreatment units of catalytic cracking feedstocks operate, however, under severe temperature and pressure conditions, which assumes an important investment effort. In addition, the entire feedstock should be desulfurized, which involves the treatment of very large volumes of feedstock.

The hydrotreatment (or hydrodesulfurization) of the catalytic cracking gasolines, when it is carried out under standard conditions that are known to one skilled in the art, makes it possible to reduce the sulfur content of the fraction. This process, however, has the major drawback of causing a very significant drop in the octane number of the fraction caused by the saturation of all of the olefins during hydrotreatment.

The separation of light gasoline and heavy gasoline before hydrotreatment has already been claimed in U.S. Pat. No. 4,397,739. This patent claims a process for hydrodesulfurization of the gasolines that comprises a fractionation of the gasoline into a light fraction and a heavy fraction and a specific hydrodesulfurization of the heavy fraction.

In contrast, U.S. Pat. No. 4,131,537 teaches that it is advantageous to fractionate the gasoline into several fractions, preferably three, as a function of their boiling point and to desulfurize them under conditions that may be different and in the presence of a catalyst that comprises at least one metal of group VIB and/or of group VIII. This patent indicates that the greatest benefit is obtained when the gasoline is fractionated into three fractions and when the fraction that has intermediate boiling points is treated under mild conditions.

Patent Application EP-A-0 725 126 describes a process for hydrodesulfurization of a cracking gasoline in which the gasoline is separated into a number of fractions that comprise at least a first fraction that is rich in compounds that are easy to desulfurize and a second fraction that is rich in compounds that are difficult to desulfurize. Before carrying out this separation, it is necessary to determine in advance the distribution of sulfur containing products using analyses. These analyses are necessary for selecting the equipment and the separation conditions.

This application thus indicates that the olefin content and the octane number of a light cracking gasoline fraction drop significantly when the fraction is desulfurized without being fractionated. In contrast, the fractionation of said light fraction into 7 to 20 fractions followed by analyses of the sulfur and olefin contents of these fractions makes it possible to determine the fraction or fractions that are richest in sulfur containing compounds, which are then desulfurized simultaneously or separately and mixed with other fractions that may or may not be desulfurized. Such a procedure is complex and should be reproduced at each change in composition of the gasoline that is to be treated.

French Patent Application No. 98/14 480 teaches the advantage of fractionating the gasoline into a light fraction and a heavy fraction and then in carrying out specific hydrotreatment of the light gasoline on a nickel-based catalyst, and a hydrotreatment of the heavy gasoline on a catalyst that comprises at least one metal of group VIII and/or at least one metal of group VIb.

French Patent Application No. 98/02 944 describes a process of treatment of catalytic cracking gasolines that comprises the 2-stage scheme: mild hydrotreatment with optional stripping of the $H_2S$ that is produced, and then elimination of mercaptans. This process makes it possible to eliminate nearly all of the mercaptans during the second stage, but the overall hydrodesulfurization rate at the end of the two stages is limited, mainly when the operation is performed with recycling of unconsumed hydrogen that optionally contains hydrogen sulfide ($H_2S$)

Processes for hydrotreatment of gasolines that consist in fractionating the gasoline, then in desulfurizing the fractions and converting the desulfurized fraction to a ZSM-5 zeolite to compensate the octane loss that is recorded with an isomerization, have also been proposed, for example, in U.S. Pat. No. 5,290,427.

U.S. Pat. No. 5,318,690 proposes a process with a gasoline fractionation and a softening of the light fraction, while the heavy fraction is desulfurized, then converted to ZSM-5 and desulfurized again under mild conditions. This technique is based on a separation of the crude gasoline to obtain a light fraction that is virtually lacking in sulfur containing compounds other than mercaptans. This makes it possible to treat said fraction only with a softening that removes the mercaptans.

The heavy fraction thus contains a relatively large amount of olefins that are partly saturated during the hydrotreatment. To compensate the drop of the octane number that is associated with the hydrogenation of the olefins, the patent recommends cracking on zeolite ZSM-5 which produces olefins, but to the detriment of the yield. In addition, these olefins can recombine with the $H_2S$ that is present in the medium for reforming mercaptans. It is then necessary to carry out a softening or an additional hydrodesulfurization.

SUMMARY OF THE INVENTION

This invention relates to a process for the production of gasolines with low sulfur contents, which makes it possible to upgrade the entire gasoline fraction that contains sulfur, preferably a catalytic cracking gasoline fraction, and to reduce the sulfur contents in said gasoline fraction to very low levels, without appreciable reduction of the gasoline yield while minimizing the reduction of the octane number caused by the hydrogenation of the olefins.

The process according to the invention is a process for the production of gasoline with a low sulfur content from a gasoline fraction that contains sulfur. In the process according to the invention, it is not necessary to fractionate the feedstock, which therefore preferably consists of the entire gasoline fraction. This constitutes an advantage that is both technical and economical relative to most of the processes that are described in the prior art. The process according to the invention comprises at least one treatment of the feedstock on a first catalyst that makes it possible to hydrogenate at least partially the unsaturated sulfur containing compounds, in particular the cyclic, and even aromatic sulfur containing compounds such as, for example, the thiophenic compounds, by being placed under conditions where the hydrogenation of the olefins is limited to this catalyst, then a second treatment on a second catalyst that makes it possible to decompose the linear and/or cyclic saturated, sulfur containing compounds, with a limited hydrogenation of olefins.

The two catalytic treatments can be carried out either in a common reactor with a scheme of the two catalysts, or in two different reactors. In some cases, it is also desirable to add a pretreatment stage, preferably a catalytic stage, whose object is to hydrogenate the diolefins of the feedstock before the first stage of the process according to the invention.

The feedstock of the process according to the invention is a gasoline fraction that contains sulfur, preferably a gasoline fraction that is obtained from a catalytic cracking unit, whose range of boiling points typically extends from about the boiling points of hydrocarbons with five carbon atoms (C5) to about 250° C. The end point of the gasoline fraction depends on the refinery from which it is obtained and the market constraints, but it generally remains within the limits that are indicated above.

For this type of gasoline, a chromatographic analysis of the sulfur containing compounds shows that the different compounds that are described below are encountered, among others: methanethiol, ethanethiol, propanethiol, thiophenol, thiacyclobutane, butanethiol, pentanethiol, 2-methylthiophene, 3-methylthiophene, thiacyclopentane, 2-methylthiacyclopentane, 2-ethylthiopentene, 3-ethylthiophene, 2-5 dimethylthiophene, 3-methylthiacyclopentane, 2,4-dimethylthiophene, 2,3-dimethylthiophene, 2,5-dimethylthiacyclopentane, 3,3-dimethylthiacyclopentane, 3,4-dimethylthiophene, 2,3-dimethylthiocyclopentane, 2-isopropyl thiophene, 3-isopropylthiophene, 3-ethyl2methylthiophene, thiophenel, 2,3,4 trimethylthiophene, 2,3,5 trimethylthiophene, benzothiophene.

Based on the fraction point of the gasoline and operating conditions of the catalytic cracking unit, some compounds may quite obviously be absent from this gasoline. In addition, when feedstocks with high boiling points are treated, the presence of alkylated benzothiophene compounds is also conceivable, and even compounds that are derived from dibenzothiophene.

The process according to the invention generally comprises at least a first stage (stage a) that is carried out by passage of the feedstock, preferably consisting of the entire gasoline fraction, on a catalyst that makes it possible to hydrogenate at least in part the unsaturated sulfur containing compounds that are present in said feedstock, such as, for example, the thiophenic compounds, of saturated compounds, such as, for example, thiophanes (or thiacyclopentane) or the mercaptans according to a series of reactions that are described below:

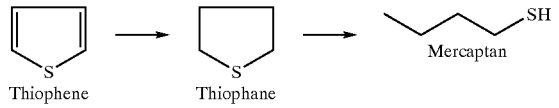

This hydrogenation reaction can be carried out on any catalyst that promotes these reactions, such as, for example, a catalyst that comprises at least one metal of group VIII and/or at least one metal of group VIb, preferably at least in part in sulfide form. When such a catalyst is used, the operating conditions are adjusted to be able to hydrogenate at least in part the saturated compounds, such as thiophenic compounds, while limiting the hydrogenation of the olefins.

The process according to the invention comprises a second stage (stage b) in which the sulfur containing saturated compounds are converted into $H_2S$ according to the reactions:

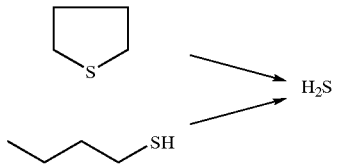

This treatment can be carried out on any catalyst that makes possible the conversion of saturated sulfur compounds (mainly the thiophane-type or mercaptan-type compounds). It can be carried out, for example, on a nickel-, molybdenum- or cobalt-based catalyst.

The thus desulfurized gasoline is then optionally stripped (i.e., a gaseous current that preferably contains one or more inert gases is passed through this gasoline) to eliminate the $H_2S$ that is produced during the hydrodesulfurization.

The expressions first stage (stage a) and second stage (stage b) do not exclude the optional presence of another stage, in particular a stage for pretreatment of the feedstock, that consists of, for example, the selective hydrogenation of dienes that are present in the feedstock. Such an optional pretreatment stage is preferably located above stage a of the process according to the invention.

DETAILED DESCRIPTION OF THE INVENTION

It was unexpectedly discovered that the association of two suitable catalysts, a first catalyst that promotes the transformation of unsaturated sulfur compounds that are present in the gasoline, such as, for example, thiophenic compounds, and at least a second catalyst that promotes the selective transformation of sulfur-saturated compounds that are linear or cyclic and are already present in the gasoline or produced during the first stage, makes it possible to obtain in fine a desulfurized gasoline that has no significant reduction in the olefin content or the octane number; this is so without it being necessary to fractionate the gasoline or to have recourse to processes that make it impossible to recover the octane number of the gasoline. Significant hydrodesulfurization rates are achieved under reasonable operating conditions that are specified below, including when the operation is carried out with recycling of unconsumed hydrogen that optionally contains hydrogen sulfide ($H_2s$).

The sulfur containing radicals that are contained in the feedstocks that are treated by the process of the invention can be mercaptans or heterocyclic compounds, such as, for example, the thiophenes, or alkyl-thiophenes, or heavier compounds, such as, for example, benzothiophene or dibenzothiophene. These heterocyclic compounds, contrary to the mercaptans, cannot be eliminated by the extractive processes. In contrast, these sulfur containing compounds are eliminated by the process according to the invention, which results in their at least partial decomposition into hydrocarbons and $H_2S$.

The sulfur content of the gasoline fractions that are produced by catalytic cracking (FCC) depends on the sulfur content of the feedstock that is treated with FCC, as well as the end point of the fraction. Generally, the sulfur contents of the entirety of a gasoline fraction, in particular those that come from the FCC, are greater than 100 ppm by weight and most of the time greater than 500 ppm by weight. For gasolines that have end points that are greater than 200° C., the sulfur contents are often higher than 1000 ppm by weight; they can even, in some cases, reach values on the order of 4,000 to 5,000 ppm by weight.

The stages of the process according to the invention are described in more detail below.

Hydrogenation of the Dienes

The hydrogenation of the dienes is an optional, but advantageous stage, which makes it possible to eliminate, before hydrodesulfurization, almost all of the dienes that are present in the gasoline fraction that contains the sulfur that is to be treated. It preferably takes place before the first stage (stage a) of the process according to the invention, generally in the presence of a catalyst that comprises at least one metal of group VIII, preferably selected from the group that is formed by platinum, palladium and nickel, and a substrate. For example, a nickel-based catalyst that is deposited on an inert substrate, such as, for example, alumina, silica or a substrate that contains at least 50% of alumina will be used. This catalyst operates under a pressure of 0.4 to 5 MPa, at a temperature of 50 to 250° C., with an hourly liquid space velocity of the liquid from 1 to 10 $h^{-1}$. Another metal can be associated to form a bimetallic catalyst, such as, for example, molybdenum or tungsten.

It can be particularly advantageous, mainly when fractions are treated whose boiling point is less than 160° C., to operate under conditions such that an at least partial softening of the gasoline is obtained, i.e., a certain reduction of the mercaptan content. To do this, it is possible to use the diene hydrogenation procedure that is described in Patent Application EP-A-0 832 958, which advantageously uses a palladium-based catalyst.

The selection of operating conditions is particularly important. The operation most generally will be performed under pressure in the presence of an amount of hydrogen that is excess relative to the stoichiometric value that is necessary for hydrogenating the diolefins. The hydrogen and the feedstock that are to be treated are injected in upward or downward flows in a reactor that preferably comprises a fixed catalyst bed. The temperature is most generally between about 50 and about 250° C., and preferably between 80 and 200° C., and more preferably between 160 and 190° C.

The pressure that is used is adequate for maintaining more than 80% and preferably more than 95% by weight of the gasoline that is to be treated in liquid phase in the reactor; it is most generally between about 0.4 and about 5 MPa and preferably greater than 1 MPa and more preferably between 1 and 4 MPa. The liquid space velocity is between about 1 and about 10 $h^{-1}$, preferably between 4 and 10 $h^{-1}$.

The catalytic cracking gasoline can contain up to several % by weight of diolefins. After hydrogenation, the diolefin content is generally reduced to less than 3000 ppm, and even less than 2500 ppm and more preferably less than 1500 ppm. In some cases, less than 500 ppm may be obtained. After selective hydrogenation, the diene content may even be reduced, if necessary, to less than 250 ppm.

According to an embodiment of the invention, the diene hydrogenation stage takes place in a catalytic hydrogenation reactor that comprises a catalytic reaction zone through which passes the entire feedstock and the amount of hydrogen that is necessary to carry out the desired reactions.

Hydrogenation of Unsaturated Sulfur Compounds (Stage a)

This stage consists in transforming at least a portion of the unsaturated sulfur compounds, such as the thiophenic compounds, into saturated compounds, for example, thiophanes (or thiacyclopentanes) or mercaptans.

This stage can be carried out, for example, by passage of the feedstock, in the presence of hydrogen, onto a catalyst that comprises at least one element of group VIII and/or at least one element of group VIb at least partly in sulfide form at a temperature of between about 210° C. and about 320° C., preferably between 220° C. and 290° C., under a pressure that is generally between about 1 and about 4 MPa, preferably between 1.5 and 3 MPa. The liquid space velocity of the liquid is between about 1 and about 10 $h^{-1}$ (expressed by volume of liquid per volume of catalyst and per hour), preferably between 3 and 8 $h^{-1}$. The $H_2$/HC ratio is between 100 to 600 liters per liter and preferably between 300 and 600 liters per liter.

To carry out, at least in part, the hydrogenation of unsaturated sulfur containing compounds of the gasoline according to the process of the invention, in general at least one catalyst is used that comprises at least one element of group VIII (metals of groups 8, 9 and 10 of the new classification, i.e., iron, ruthenium, osmium, cobalt, rhodium, iridium, nickel, palladium or platinum) and/or at least one element of group VIb (metals of group 6 of the new classification, i.e., chromium, molybdenum or tungsten) on an appropriate substrate. The element of group VIII, when it is present, is generally nickel or cobalt, and the element of group VIb, when it is present, is generally molybdenum or tungsten. Combinations such as nickel-molybdenum or cobalt-molybdenum are preferred. The substrate of the catalyst is usually a porous solid, such as, for example, an alumina, a silica-alumina or other porous solids, such as, for example, magnesia, silica or titanium oxide, alone or mixed with alumina or silica-alumina.

After introduction of one or more elements and optionally shaping of the catalyst (when this stage is carried out on a mixture that already contains the basic elements), the catalyst is in a first activated stage. This activation may correspond either to an oxidation, then to a reduction, or to a direct reduction or to a calcination alone. The calcination stage is generally carried out at temperatures from about 100 to about 600° C. and preferably between 200 and 450° C. under an air flow. The reduction stage is carried out under conditions that make it possible to convert at least a portion of the oxidized forms of base metal into metal. It generally consists in treating the catalyst under a hydrogen flow at a temperature that is preferably at least equal to 300° C. The reduction can also be carried out partly with chemical reducing agents.

The catalyst is preferably used at least in part in its sulfurized form. The introduction of the sulfur can take effect before or after every activation stage, i.e., calcination or reduction stage. Preferably, no oxidation stage is carried out when the sulfur or a sulfur containing compound has been introduced onto the catalyst. The sulfur or a sulfur containing compound can be introduced ex situ, i.e., apart from the reactor where the process according to the invention is carried out, or in situ, i.e., in the reactor that is used for the process according to the invention. In the latter case, the catalyst is preferably reduced under the conditions that are described above, then sulfurized by passage of a feedstock that contains at least one sulfur containing compound, which, once decomposed, results in the attachment of sulfur to the catalyst. This feedstock can be gaseous or liquid, for example hydrogen that contains $H_2S$, or a liquid that contains at least one sulfur containing compound.

In a preferred way, the sulfur containing compound is added to the catalyst ex situ. For example, after the calcination stage, a sulfur containing compound can be introduced into the catalyst optionally in the presence of another compound. The catalyst is then dried, then transferred into the reactor that is used to implement the process according to the invention. In this reactor, the catalyst is then treated under hydrogen to transform at least a portion of the main metal into sulfide. A procedure that is suitable particularly to the invention is that described in Patents FR-B-2 708 596 and FR-B-2 708 597.

According to the process of the invention, the conversion of the unsaturated sulfur containing compounds is greater than 15% and preferably greater than 50%. In the same step, the hydrogenation rate of the olefins is preferably less than 50% and preferably less than 40% during this stage.

The effluent that is obtained from this first hydrogenation stage is then sent to the catalyst which makes it possible to decompose the sulfur containing compounds that are saturated with $H_2S$.

Decomposition of Saturated Sulfur Compounds (Stage b)

In this stage, the saturated sulfur compounds are transformed in the presence of hydrogen on a suitable catalyst. This transformation is carried out, without significant hydrogenation of olefins, i.e., during this stage, the hydrogenation of the olefins is generally limited to 20% by volume relative to the olefin content of the starting gasoline, and preferably limited to 10% by volume relative to the olefin content of the gasoline.

The catalysts that can be suitable for this stage of the process according to the invention, without this list being limiting, are catalysts that comprise at least one base metal that is selected from the group that is formed by nickel, cobalt, iron, molybdenum, and tungsten. These metals can be used alone or in combination; they are preferably supported and used in their sulfurized form.

The base metal content of the catalyst according to the invention is generally between about 1 and about 60% by weight, preferably between 5 and 20% by weight. In a preferred way, the catalyst is generally shaped, preferably in the form of balls, pellets, extrudates, for example three-lobes. The metal can be incorporated in the catalyst by deposition on the preformed substrate; it can also be mixed with the substrate before the shaping stage. The metal is generally introduced in the form of a precursor salt that is generally water-soluble, such as, for example, nitrates and heptamolybdates. This method of introduction is not specific to the invention. Any other method of introduction that is known to one skilled in the art is suitable for the invention.

The substrates of the catalysts that are used in this stage of the process according to the invention are generally porous solids that are selected from among the refractory oxides, such as, for example, the aluminas, silicas and silica-aluminas, magnesia, as well as titanium oxide and zinc oxide, whereby these latter oxides can be used alone or in a mixture with the alumina or the silica-alumina. The substrates preferably are transition aluminas or silicas whose specific surface area is 25 and 350 $m^2/g$. The natural compounds, such as, for example, diatomaceous earth or kaolin, can also be suitable as substrates of the catalysts that are used in this stage of the process.

After the base metal is introduced and after optional shaping of the catalyst (when this stage is carried out starting from a mixture that already contains base metal), the catalyst is in a first activated stage. This activation can correspond either to an oxidation, then to a reduction, or to a direct reduction or else only to a calcination. The calcination stage is generally carried out at temperatures from about 100 to about 600° C. and preferably between 200 and 450°C., under a flow of air. The reduction stage is carried out under conditions that make it possible to convert at least a portion of the oxidized forms of base metal into metal. Generally, it consists in treating the catalyst under a hydrogen flow at a temperature that is at least equal to 300° C. The reduction can also be carried out in part with chemical reducing agents.

The catalyst is preferably used at least in part in its sulfurized form. This offers the advantage of limiting as much as possible the hydrogenation risks of the unsaturated compounds, such as olefins or aromatic compounds during the start-up phase. The introduction of sulfur can take place between different activation stages. Preferably, no oxidation stage is carried out when the sulfur or a sulfur containing compound is introduced onto the catalyst. The sulfur or a sulfur containing compound can be introduced ex situ, i.e., apart from the reactor where the process according to the invention is carried out, or in situ, i.e., in the reactor that is used for the process according to the invention. In the latter case, the catalyst is preferably reduced under the conditions that are described above, then sulfurized by passage of a feedstock that contains at least one sulfur containing compound, which, once decomposed, results in the attachment of sulfur onto the catalyst. This feedstock can be gaseous or liquid, for example with hydrogen that contains $H_2S$, or a liquid that contains at least one sulfur containing compound.

The sulfur containing compound is preferably added to the catalyst ex situ. For example, after the calcination stage, a sulfur containing compound can be introduced onto the catalyst in the presence optionally of another compound. The catalyst is then dried, then transferred into the reactor that is used to implement the process of the invention. In this reactor, the catalyst is then treated under hydrogen to transform at least a portion of the main metal into sulfide. A procedure that is suitable particularly for the invention is the one that is described in Patents FR-B-2 708 596 and FR-B-2 708 597.

After sulfurization, the sulfur content of the catalyst is generally between 0.5 and 25% by weight, preferably between 4 and 20% by weight and very preferably between 4 and 10% by weight.

The hydrodesulfurization that was carried out during this stage had the object of converting into $H_2S$ the saturated sulfur containing compounds of the gasoline that already underwent at least one hydrogenation in advance of the unsaturated sulfur compounds to obtain an effluent, which will meet the desired specifications in terms of content in sulfur containing compound. The gasoline that is thus obtained has only a small loss of octane.

It has been found that the use of this second catalyst in this stage, under special operating conditions, makes it possible to decompose the saturated compounds that are contained in the effluent that is obtained from the preceding stage into $H_2S$. This use makes it possible to achieve a high comprehensive hydrodesulfurization rate at the end of all of the stages of the process according to the invention, while minimizing the octane loss that results from the saturation of the olefins, because the conversion of the olefins during stage b is generally limited to at most 20% by volume of the olefins, preferably at most 10% by volume.

The treatment whose purpose is to decompose the saturated sulfur containing compounds that are obtained from the first stage of the process is carried out in the presence of hydrogen, with the catalyst that comprises at least one base metal that is selected from the group that is formed by nickel, cobalt, iron, molybdenum, tungsten, at a temperature that is between about 250° C. and about 350° C., preferably between about 260° C. and about 350° C., more preferably between about 260° C. and about 320° C. under a low to moderate pressure, generally between about 0.5 and about 5 MPa, preferably between 0.5 and 3 Mpa, more preferably between 1 and 3 MPa. The liquid space velocity of the liquid is between about 0.5 and about 10 $h^{-1}$ (expressed by volume of liquid per volume of catalyst and per hour) and preferably between 1 and 8 $h^{-1}$. The $H_2$/HC ratio is adjusted based on the desired hydrodesulfurization rates in the range of between about 100 and about 600 liters per liter, preferably between 100 and 300 liters per liter. Some or all of this hydrogen can come from stage a or a recycling of unconsumed hydrogen that is obtained from stage b. This hydrogen that is obtained from stages a or b can optionally contain unseparated $H_2S$.

Preferred Implementations of the Process According to the Invention

One of the possible implementations of the process according to the invention consists in, for example, passing the gasoline that is to be hydrodesulfurized through two separate reactors that respectively contain, for the first reactor: some or all, preferably all, of a catalyst that makes possible, at least partly, the hydrogenation of unsaturated sulfur containing compounds (stage a), such as, for example, the thiophenic compounds, into saturated sulfur compounds (such as, for example, the thiacyclopentanes or mercaptans) and for the second reactor: a catalyst that makes it possible to decompose the saturated sulfur compounds into $H_2S$ (stage b) and optionally another portion of the catalyst that is necessary for stage a, preferably at the top of the bed. Between the two reactors, systems can be implanted optionally to dissociate the operating conditions of the two reaction zones.

In another configuration of the process according to the invention, the two catalysts can be placed in series in the same reactor.

In the two cases, the two catalytic zones can operate under different or identical conditions of pressure, temperature, VVH and $H_2$/feedstock ratio.

In short, the process according to the invention consists of a process for the production of gasoline with a low sulfur content, characterized in that it comprises at least two stages:

a) a hydrogenation stage of the unsaturated sulfur containing compounds;

b) a decomposition stage of the saturated sulfur containing compounds, in which:

- a pretreatment stage whose purpose is to hydrogenate the diolefins of the feedstock is optionally carried out before stage a;
- the feedstock preferably consists of an entire gasoline fraction, preferably a catalytic cracking gasoline;
- stage a is carried out by passage of the feedstock, in the presence of hydrogen, onto a catalyst that makes it possible to hydrogenate the unsaturated sulfur compounds and that preferably comprises at least one element of group VIII and/or at least one element of group VIb at least partly in sulfurized form, and in which the element of group VIII, when it is present, is preferably nickel or cobalt, and the element of group VIb, when it is present, is preferably molybdenum or tungsten;
- stage a is carried out at a temperature that is between about 210° C. and about 320° C., under a pressure that is generally between about 1 and about 4 MPa, with a liquid space velocity that is between about 1 and about 10 $h^{-1}$, and an $H_2$/HC ratio that is between about 100 and about 600 liters;
- stage b is carried out in the presence of a catalyst that makes it possible to decompose the saturated sulfur compounds and that preferably comprises at least one base metal that is selected from the group that is formed by nickel, cobalt, iron, molybdenum, tungsten, whereby the base metal content is between 1 and 60% by weight, preferably between 5 and 20% by weight, and whereby said metal is preferably sulfurized;
- stage b is carried out a temperature of between about 250° C. and about 350° C., a pressure of between about 0.5 and about 5 MPa, a liquid space velocity of between about 0.5 and about 10 $h^{-1}$ and an $H_2$/HC ratio of between about 100 and about 600 liters per liter;
- the process can optionally be implemented with a single reactor that contains the catalysts that are necessary for stages a and b, not including the reactor for pretreatment of the feedstock (such as, for example, a reactor for hydrogenation of the dienes). It can also optionally be implemented with at least two separate reactors, not including the reactor for pretreatment of the feedstock, whereby the first reactor contains the catalyst that is necessary for stage a and the second being at least the one that is necessary for stage b.

With the process according to the invention as described, it is possible to achieve high hydrodesulfurization rates while limiting the olefin loss and consequently the reduction of the octane number.

The examples below illustrate the invention.

Table 1 presents the characteristics of the feedstocks (catalytic cracking gasolines) that are treated by the process according to the invention. The methods of analyses that are used to identify the feedstocks and effluents are as follows:

- gas chromatography (CPG) for the components that contain hydrocarbon;
- NF M 07052 method for total sulfur;
- NF EN 25164/M 07026-2/ISO 5164/ASTM D 2699 method for the research octane number;

NF EN 25163/M 07026-1/ISO 5163/ASTM D 2700 method for the motor octane number.

TABLE 1

Characteristics of the Feedstock Used.

| | Feedstock |
|---|---|
| Density | 0.75 |
| Starting Point (° C.) | 40°C. |
| End Point (° C.) | 200°C. |
| Olefin Content (% by volume) | 32 |
| Total S (ppm) | 1200 |
| RON | 90 |
| MON | 78 |
| (RON + MON)/2 | 84 |

The analysis of the sulfur containing compounds of the feedstock by gas chromatography coupled with a specific PFDP (Pulse Flame Photometry Detector)-type detector leads to the results that are presented in Table 2.

TABLE 2

Nature and Concentration of the Sulfur containing Compounds that are Present in the Feedstock.

| Identified Sulfur containing Compounds | Concentration (ppm) |
|---|---|
| THIOPHENE | 235 |
| Mercaptans | 0 |
| Methylthiophenes | 487 |
| Thiacyclopentane | 82 |
| Methylthiacyclopentane | 40 |
| C2 thiophenes | 227 |
| Diethyl sulfide | 11 |
| C3 thiophenes | 26 |
| C2 thiacyclopentanes | 46 |
| C3 thiacyclopentanes | 46 |

EXAMPLE 1 (FOR COMPARISON)

Hydrodesulfurization of the Gasoline on a Catalyst That Makes Possible the Conversion of Unsaturated Sulfur Containing Products 25 ml of the HR306® catalyst, marketed by the Procatalyse Company, is placed in an isothermal tubular reactor with a fixed catalyst bed. The catalyst is first sulfurized by treatment for 4 hours under a pressure of 3.4 MPa at 350° C., in contact with a feedstock that consists of 2% by weight of sulfur in the form of dimethyl disulfide in n-heptane.

The operating conditions of hydrodesulfurization are as follows: VVH=4 $h^{-1}$, $H_2$/HC=400 1/1, P=2.7 MPa. Under these conditions, the effluent after desulfurization at 220° C., 230° C. and 250° C., the characteristics described in Table 3.

TABLE 3

Comparison of the Characteristics of the Feedstock and of the Desulfurized Effluent.

| Temperature (° C.) | Feedstock | Effluent 220° C. | Effluent 230° C. | Effluent 250° C. |
|---|---|---|---|---|
| Total S (ppm) | 1200 | 587 | 305 | 96 |
| Olefins (% by vol.) | 32 | 27 | 24 | 16 |
| MON | 78 | 77.5 | 77 | 75 |
| RON | 90 | 89.1 | 87.7 | 83 |
| (RON + MON)/2 | 84 | 83.3 | 82.4 | 79 |
| Octane loss | — | 0.7 | 1.6 | 5 |

TABLE 3-continued

Comparison of the Characteristics of the Feedstock and of the Desulfurized Effluent.

| Temperature (° C.) | Feedstock | Effluent 220° C. | Effluent 230° C. | Effluent 250° C. |
|---|---|---|---|---|
| % of HDS* | | 51 | 75 | 92 |
| % of HDO** | | 16 | 25 | 50 |

*% of HDS refers to the hydrodesulfurization rate
**% of HDO refers to the hydrogenation rate of the olefins These results show that in the cobalt- and molybdenum-based catalyst, the achievement of the high desulfurization rates is accompanied by a significant olefin loss and therefore a significant octane loss.

The analysis of the nature of the sulfur containing compounds that are present in the effluents leads to the results that are presented in Table 4.

TABLE 4

| Identified Sulfur containing Compounds | Conc. of the feedstock (ppm) | Conc. of the effluent 51% HDS (ppm) | Conc. of the effluent 75% HDS (ppm) | Conc. of the effluent 92% HDS (ppm) |
|---|---|---|---|---|
| Thiophene | 235 | 45 | 19 | 0 |
| Mercaptans | 0 | 161 | 125 | 68 |
| Methylthiophenes | 487 | 53 | 25 | 0 |
| Thiacyclopentane | 82 | 71 | 16 | 8 |
| Methylthiacyclopentane | 40 | 105 | 55 | 15 |
| C2 Thiophenes | 227 | 68 | 16 | 0 |
| Diethyl Sulfide | 11 | 0 | 0 | 0 |
| C3 Thiophenes | 26 | 8 | 4 | 0 |
| C2 Thiacyclopentanes | 46 | 65 | 35 | 5 |
| C3 Thiacyclopentanes | 46 | 11 | 10 | 5 |

It can be noted that in this catalyst, the unsaturated sulfur compounds are converted to a large extent, even if the desulfurization rate is less than 75%.

EXAMPLE 2 (COMPARATIVE)

Hydrodesulfurization of the Gasoline on a Catalyst That Makes Possible the Conversion of the Saturated Sulfur Compounds.

The gasoline whose characteristics are described in Table 1 is subjected to hydrotreatment on a nickel-based catalyst, in an isothermal tubular reactor with a fixed catalyst bed. The catalyst is prepared as follows.

It is prepared starting from a transition alumina of 140 $m^2/g$ that comes in the form of balls with a 2 mm diameter. The pore volume is 1 ml/g of substrate. 1 kilogram of substrate is impregnated by 1 liter of nickel nitrate solution. The catalyst is then dried at 120° C. and calcined under an air flow at 400° C. for an hour. The nickel content of the catalyst is 20% by weight. The catalyst (100 ml) is then sulfurized by treatment for 4 hours under a pressure or 3.4 MPa at 350° C., in contact with a feedstock that contains 2% by weight of sulfur in the form of dimethyl disulfide in n-heptane.

The gasoline is then subjected to hydrotreatment under the following conditions: VVH=2 $h^{-1}$, P=2.7 MPa, $H_2$/HC=400, expressed by liter of hydrogen per liter of feedstock. The temperature of the tests is 300° C. to 350° C. The characteristics of the effluents that are thus obtained are presented in Table 5.

TABLE 5

Characteristics of the Gasolines after Hydrodesulfurization (HDS) on the Nickel based Catalyst

| | Feedstock | Effluent Obtained after HDS at 300° C. | Effluent Obtained after HDS at 350° C. |
|---|---|---|---|
| Total S (ppm) | 1200 | 660 | 300 |
| Olefins (% by vol.) | 32 | 31 | 29 |
| MON | 78 | 78 | 78 |
| RON | 90 | 90 | 89 |
| (RON + MON)/2 | 84 | 84 | 83.5 |
| Octane Loss | | 0 | 0.5 |
| % of HDS | | 45 | 75 |
| % of HDO | | 3 | 9 |

The nickel-based catalyst therefore makes it possible to desulfurize the gasoline without olefin consumption. With this catalyst, however, it is difficult to achieve high hydrodesulfurization rates, except by working at temperatures that are significantly higher than 300° C., which produces a larger octane loss and imposes constraints in terms of the process.

The results of analysis of the nature and the concentration of the sulfur containing compounds that are obtained after hydrodesulfurization (HDS) are recorded in Table 6.

TABLE 6

| Identified Sulfur containing Compounds | Conc. of the feed-stock (ppm) | Conc. of the effluent 45% HDS (ppm) | Conc. of the effluent 75% HDS (ppm) |
|---|---|---|---|
| Thiophene | 235 | 132 | 147 |
| Mercaptans | 0 | 30 | 3 |
| Methylthiophenes | 487 | 271 | 92 |
| Thiacyclopentane | 82 | 12 | 2 |
| Methylthiacyclopentane | 40 | 5 | 1 |
| C2 Thiophenes | 227 | 202 | 47 |
| Diethyl Sulfide | 11 | 0 | 0 |
| C3 Thiophenes | 26 | 8 | 8 |
| C2 Thiacyclopentanes | 46 | 0 | 0 |
| C3 Thiacyclopentanes | 46 | 0 | 0 |

It can therefore be noted that in this type of catalyst, the saturated sulfur compounds are converted to a significant extent.

EXAMPLE 3 (COMPARATIVE)

Hydrodesulfurization With a Cobalt-Molybdenum Catalyst and Recycling of Hydrogen The gasoline whose characteristics are described in Table 1 is subjected to hydrodesulfurization on a conventional hydrotreatment catalyst in an isothermal tubular reactor. 25 ml of the HR306C® catalyst, marketed by the Procatalyse Company, is placed in the hydrodesulfurization reactor. The catalyst is first sulfurized by treatment for 4 hours under a pressure 3.4 MPa at 350° C., in contact with a feedstock that consists of 2% by weight of sulfur in the form of dimethyl disulfide in n-heptane.

The operating conditions of the hydrodesulfurization are as follows: VVH=4 $h^{-1}$, $H_2$/HC=400 1/1, P=2.7 MPa. The partial $H_2S$ pressure at the inlet of the reactor of 0.023 MPa to simulate $H_2S$ provided by the recycling of hydrogen at the level of the unit. The temperature was brought to 250° C., then 270° C. The characteristics of the effluents that are thus obtained are presented in Table 7.

TABLE 7

Characteristics of the Gasolines after Hydrodesulfurization with the Cobalt- and Molybdenum-Based Catalyst

| | Feedstock | Effluent Obtained after HDS at 250° C. | Effluent Obtained after HDS at 270° C. |
|---|---|---|---|
| Total S (ppm) | 1200 | 1100 | 953 |
| Olefins (% by vol.) | 32 | 19 | 12 |
| MON | 78 | 76 | 75 |
| RON | 90 | 84 | 81 |
| (RON + MON)/2 | 84 | 80 | 78 |
| Octane loss | | 4 | 6 |
| % of HDS | | 8 | 21 |
| % of HDO | | 41 | 63 |

These results show that in the presence of $H_2S$, it is difficult to obtain a high HDS rate with a limited olefin loss on the sulfurized catalysts. This type of catalyst consequently requires the use of $H_2S$-poor hydrogen to result in good performances, which in some cases can increase the cost of the process.

Table 8 presents the results of analysis of the nature and the concentration of the sulfur containing compounds that are obtained after hydrodesulfurization.

TABLE 8

| Identified Sulfur containing Compounds | Conc. of the feed-stock (ppm) | Conc. of the effluent 8% HDS (ppm) | Conc. of the effluent 20% HDS (ppm) |
|---|---|---|---|
| Thiophene | 235 | 10 | 0 |
| Mercaptans | 0 | 699 | 631 |
| Methylthiophenes | 487 | 5 | 0 |
| Thiacyclopentane | 82 | 150 | 173 |
| Methylthiacyclopentane | 40 | 85 | 60 |
| C2 Thiophenes | 227 | 18 | 0 |
| Diethyl Sulfide | 11 | 0 | 0 |
| C3 Thiophenes | 26 | 0 | 0 |
| C2 Thiacyclopentanes | 46 | 98 | 53 |
| C3 Thiacyclopentanes | 46 | 35 | 36 |

EXAMPLE 4 (ACCORDING TO THE INVENTION)

Hydrodesulfurization With a Scheme of Catalysts for Hydrogenation of Unsaturated Compounds Then for Decomposition of Saturated Sulfur Compounds and With Recycling of Hydrogen The gasoline whose characteristics are described in Table 1 is subjected to hydrodesulfurization in a catalyst scheme in an isothermal tubular reactor. 25 ml of the HR306C® catalyst, marketed by the Procatalyse Company, and 50 ml of the catalyst that is obtained according to the same procedure as the one that is described in Example 2 are placed in the hydrodesulfurization reactor. The catalysts are first sulfurized by treatment for 4 hours under a pressure of 3.4 MPa at 350° C., in contact with a feedstock that consists of 2% of sulfur in the form of dimethyl disulfide in n-heptane.

The operating conditions of the hydrodesulfurization are as follows: VVH=1.33 $h^{-1}$ relative to the entire catalytic bed $H_2$/HC=400 1/1, P=2.7 MPa. The temperature of the catalytic zone that comprises the HR306C® catalyst is 250° C.; the temperature of the catalytic zone that contains the catalyst of Example 2 is 290° C. To simulate the $H_2S$ that is provided by the recycling of hydrogen, an amount of $H_2S$ that corresponds to a partial pressure of 0.023 MPa is injected at the inlet of the reactor.

The characteristics of the effluent that is thus obtained are presented in Table 9.

TABLE 9

Characteristics of the Gasolines after Hydrodesulfurization with the Scheme of Catalysts

| | Feedstock | Effluent |
|---|---|---|
| Total S (ppm) | 1200 | 96 |
| Olefins (% by volume) | 32 | 23 |
| MON | 78 | 77 |
| RON | 90 | 87 |
| (RON + MON)/2 | 84 | 82 |
| Octane Loss | | 2.0 |
| % of HDS | | 92 |
| % of HDO | | 28 |

Thus with the catalyst scheme, it is possible to achieve high hydrodesulfurization rates, with a limited olefin consumption and an operating temperature of the catalyst that makes it possible to convert the saturated sulfur compounds that is lower than the temperature in the case where it is used by itself to treat the starting gasoline.

EXAMPLE 5 (ACCORDING TO THE INVENTION)

Hydrodesulfurization With a Scheme of Catalysts for Hydrogenation of Unsaturated Compounds and for Decomposition of Saturated Sulfur Compounds, With Recycling of Hydrogen The gasoline whose characteristics are described in Table 1 is subjected to hydrodesulfurization on a scheme of catalysts in an isothermal tubular reactor. 25 ml of the HR306C® catalyst, marketed by the Procatalyse Company, and 50 ml of the catalyst that is obtained according to the same procedure as the one that is described in Example 2 are placed in the hydrodesulfurization reactor. The catalysts are first sulfurized by treatment for 4 hours under a pressure of 3.4 MPa at 350° C., in contact with a feedstock that consists of 2% of sulfur in the form of dimethyl disulfide in n-heptane.

The operating conditions of the hydrodesulfurization are as follows: VVH=1.33 $h^{-1}$ relative to the entire catalytic bed; $H_2$/HC=400 1/1, P=2.7 MPa. The temperature of the catalytic zone that comprises the HR306C® catalyst is 230° C.; the temperature of the catalytic zone that contains the catalyst of Example 2 is 270° C. To simulate the $H_2S$ that is provided by the recycling of the hydrogen, an amount of $H_2S$ that corresponds to a partial pressure of 0.023 MPa is injected in the inlet of the reactor.

The characteristics of the effluent that are thus obtained are presented in Table 10.

TABLE 10

Characteristics of Gasolines After Hydrodesulfurization with the Scheme of Catalysts

| | Feedstock | Effluent |
|---|---|---|
| Total S (ppm) | 1200 | 240 |
| Olefins (% by volume) | 32 | 26 |
| MON | 78 | 77.8 |

TABLE 10-continued

Characteristics of Gasolines After Hydrodesulfurization with the Scheme of Catalysts

| | Feedstock | Effluent |
|---|---|---|
| RON | 90 | 88.6 |
| (RON + MON)/2 | 84 | 83.2 |
| Octane loss | | 0.8 |
| % of HDS | | 80 |
| % of HDO | | 19 |

Thus, with the catalyst scheme, it is possible to achieve high hydrodesulfurization rates, with a limited olefin consumption and an operating temperature of the catalyst that makes it possible to convert the saturated sulfur compounds that is lower than the temperature in the case where it is used by itself.

EXAMPLE 6 (COMPARATIVE)

Hydrodesulfurization With a Scheme of Catalysts for Hydrogenation of Unsaturated Compounds and for Decomposition of Saturated Sulfur Compounds That Operates at a Low Temperature, With Recycling of Hydrogen The gasoline whose characteristics are described in Table 1 is subjected to hydrodesulfurization on a scheme of catalysts in an isothermal tubular reactor. 25 ml of the HR306C® catalyst, marketed by the Procatalyse Company, and 50 ml of the catalyst that is obtained according to the same procedure as the one that is described in Example 2 are placed in the hydrodesulfurization reactor. The catalysts are first sulfurized by treatment for 4 hours under a pressure of 3.4 MPa at 350° C., in contact with a feedstock that consists of 2% sulfur in the form of dimethyl disulfide in n-heptane.

The operating conditions of the hydrodesulfurization are as follows: VVH=1.33 $h^{-1}$ relative to the entire catalytic bed, $H_2$/HC=400 1/1, P=2.7 MPa. The temperature of the catalytic zone that comprises the HR306C® catalyst is 230° C.; the temperature of the catalytic zone that contains the catalyst of Example is 200° C. To simulate the $H_2S$ that is provided by the recycling of the hydrogen, an amount of $H_2S$ that corresponds to a partial pressure of 0.023 MPa is injected at the inlet of the reactor.

The characteristics of the effluent that is thus obtained are presented in Table 11.

TABLE 11

Characteristics of the Gasolines After Hydrodesulfurization with the Scheme of Catalysts, Whereby the Catalyst is Used to Decompose the Saturated Sulfur Compounds that Operate at Low Temperature

| | Feedstock | Effluent |
|---|---|---|
| Total S (ppm) | 1200 | 900 |
| Olefins (% by volume) | 32 | 25 |
| MON | 78 | 77.5 |
| RON | 90 | 88 |
| (RON + MON)/2 | 84 | 82.8 |
| Octane Loss | | 1.2 |
| % of HDS | | 25 |
| % of HDO | | 22 |

Thus with the catalyst scheme, but with an operation temperature of the catalyst that decomposes the saturated sulfur compounds of 200° C., it is not possible to achieve high hydrodesulfurization rates.

What is claimed is:

1. A process for the production of gasoline with a low sulfur content from a feedstock, comprising subjecting the feedstock to at least two stages:

a) a hydrogenation stage of unsaturated sulfur containing compounds at a temperature of at least 210° C. to 320° C., b) a decomposition stage of saturated sulfur containing compounds at a temperature of at least 250° C. to 350° C., wherein all of the effluent of stage a) is sent to stage b) and stage b) is at a higher temperature than stage a).

2. A process according to claim 1, further comprising a pretreatment stage before stage a for hydrogenating diolefins of the feedstock.

3. A process according to claim 1, wherein the feedstock consists of gasoline.

4. A process according to claim 1, wherein the feedstock is a catalytic cracking gasoline.

5. A process according to claim 1, wherein stage a is carried out by passage of the feedstock, in the presence of hydrogen, onto a catalyst that comprises at least one element of group VIII and/or at least one element of group VIb, at least in part in sulfide form.

6. A process according to claim 5, wherein the element of group VIII is nickel or cobalt, and the element of group VIb is molybdenum or tungsten.

7. A process according to claim 5, wherein stage a is carried out at a temperature of between about 220° C. and about 320° C., under a pressure that is between about 1 and about 4 MPA, with a liquid space velocity of between about 1 and about 10 $h^{-1}$, and an $H_2$/HC ratio of between about 100 and about 600 liters.

8. A process according to claim 1, wherein stage b is carried out in the presence of a catalyst comprising at least one base metal selected from the group consisting of nickel, cobalt, iron, molybdenum, and tungsten.

9. A process according to claim 8, wherein the base metal content is between 1 and 60% by weight, and said metal is sulfurized.

10. A process according to claim 8, wherein stage b is carried out at a pressure of between about 0.5 and about 5 MPa, a liquid space velocity of between about 0.5 and about 10 $h^{-1}$, and an $H_2$/HC ratio of between about 100 and about 600 liters per liter.

11. A process according to claim 1 conducted in a single reactor containing the catalysts necessary for stages a and b, not including a reactor for pretreatment of the feedstock.

12. A process according to claim 1, conducted in at least two separate reactors, not including a reactor for pretreatment of the feedstock, whereby the first reactor contains the catalyst necessary for stage a and the second being at least the one necessary for stage b.

13. A process according to claim 1, wherein stage a is carried out by passage of the feedstock, in the presence of hydrogen, onto a catalyst that comprises at least one element of group VIII and/or at least one element of group VIb, at least in part in sulfide form, at a temperature of between about 220° C. and about 320° C., under a pressure that is generally between about 1 and about 4 MPa, with a liquid space velocity of between about 1 and about 10 $h^{-1}$, and an $H_2$/HC ratio of between about 100 and about 600 liters, wherein stage b is carried out in the presence of a catalyst that comprises at least one base metal that is selected from the group consisting of nickel, cobalt, iron, molybdenum, and tungsten, wherein the base metal content is between 1 and 60% by weight, and said metal is sulfurized, and wherein stage b is carried out at a pressure of between about 0.5 and about 5 MPa, a liquid space velocity of between about 0.5 and about 10 $h^{-1}$, and an $H_2$/HC ratio of between about 100 and about 600 liters per liter.

14. A process according to claim 13 conducted in a single reactor that contains the catalysts that are necessary for stages a and b, not including the reactor for pretreatment of the feedstock.

15. A process according to claim 13 conducted in at least two separate reactors, not including a reactor for pretreatment of the feedstock, whereby the first reactor contains the catalyst that is necessary for stage a and the second being at least the one that is necessary for stage b.

16. A process according to claim 13, further comprising a pretreatment stage before stage a for hydrogenating diolefins of the feedstock.

17. A process according to claim 14, further comprising a pretreatment stage before stage a for hydrogenating diolefins of the feedstock.

18. A process according to claim 15, further comprising a pretreatment stage before stage a for hydrogenating diolefins of the feedstock.

19. A process according to claim 1, wherein the effluent of step a is sent to step b without the removal of $H_2S$.

* * * * *